US010801099B2

(12) United States Patent
Medvedovski

(10) Patent No.: US 10,801,099 B2
(45) Date of Patent: Oct. 13, 2020

(54) COATING COMPOSITIONS, METHODS AND ARTICLES PRODUCED THEREBY

(71) Applicant: ENDURANCE TECHNOLOGIES, INC., Calgary, Alberta (CA)

(72) Inventor: Eugene Medvedovski, Calgary (CA)

(73) Assignee: ENDURANCE TECHNOLOGIES, INC., Calgary, Alberta (CA)

( * ) Notice: Subject to any disclaimer, the term of this patent is extended or adjusted under 35 U.S.C. 154(b) by 213 days.

(21) Appl. No.: 15/799,296

(22) Filed: Oct. 31, 2017

(65) Prior Publication Data

US 2018/0057924 A1 Mar. 1, 2018

Related U.S. Application Data

(62) Division of application No. 14/632,010, filed on Feb. 26, 2015, now Pat. No. 9,957,599.

(60) Provisional application No. 61/944,681, filed on Feb. 26, 2014.

(51) Int. Cl.

| | |
|---|---|
| ***C23C 10/48*** | (2006.01) |
| ***C23C 10/50*** | (2006.01) |
| ***C23C 10/02*** | (2006.01) |

(52) U.S. Cl.

CPC ..... *C23C 10/50* (2013.01); *C23C 10/02* (2013.01); *C23C 10/48* (2013.01); *Y10T 428/12458* (2015.01); *Y10T 428/265* (2015.01)

(58) Field of Classification Search

CPC ..... C23C 10/48; C23C 10/50; C23C 10/28; C23C 10/00–60

See application file for complete search history.

(56) References Cited

U.S. PATENT DOCUMENTS

| | | | | |
|---|---|---|---|---|
| 3,667,985 | A | 6/1972 | Levine et al. | |
| 3,762,884 | A | 10/1973 | Grisaffe et al. | |
| 3,837,901 | A | 9/1974 | Seybolt | |
| 3,867,184 | A * | 2/1975 | Baldi | B01D 53/86 427/252 |
| 4,084,025 | A * | 4/1978 | Rairden, III | C23C 2/12 148/535 |
| RE31,339 | E | 8/1983 | Dardi et al. | |
| 4,571,352 | A | 2/1986 | Aoki | |
| 4,831,701 | A | 5/1989 | Yutaka | |
| 5,100,486 | A * | 3/1992 | Krikorian | C23C 10/18 148/248 |
| 5,217,757 | A | 6/1993 | Milaniak et al. | |

(Continued)

FOREIGN PATENT DOCUMENTS

| | | | |
|---|---|---|---|
| CN | 101165204 | A | 4/2008 |
| DE | 19908107 | A1 | 8/2000 |

(Continued)

OTHER PUBLICATIONS

Examination Search Report dated Nov. 1, 2017 corresponding to Canadian Patent Application No. 2,882,788, 3 pages.

(Continued)

*Primary Examiner* — Elizabeth A Burkhart

(74) *Attorney, Agent, or Firm* — Dentons US LLP

(57) ABSTRACT

Powder compositions are described having, as constituents: an aluminum donor powder, an aluminum-containing activator powder comprising at least 50 wt. % $KAlF_4$, and an inert filler powder. Related methods and coatings are also described.

23 Claims, 3 Drawing Sheets

(56) References Cited

U.S. PATENT DOCUMENTS

| | | | | |
|---|---|---|---|---|
| 5,547,770 | A | 8/1996 | Meelu et al. | |
| 5,981,089 | A | 11/1999 | Imai et al. | |
| 5,985,233 | A * | 11/1999 | Belt | C01F 7/54 423/465 |
| 6,045,863 | A | 4/2000 | Olson et al. | |
| 6,332,931 | B1 | 12/2001 | Das et al. | |
| 6,334,907 | B1 | 1/2002 | Das et al. | |
| 6,482,470 | B1 | 11/2002 | Reeves et al. | |
| 6,555,179 | B1 | 4/2003 | Reeves et al. | |
| 6,929,825 | B2 | 8/2005 | Wustman et al. | |
| 6,993,811 | B2 | 2/2006 | Das et al. | |
| 7,026,011 | B2 | 4/2006 | Wustman et al. | |
| 2003/0054191 | A1 | 3/2003 | Reeves et al. | |
| 2009/0134035 | A1 | 5/2009 | Minor | |

FOREIGN PATENT DOCUMENTS

| | | | |
|---|---|---|---|
| EP | 0567755 | A1 | 11/1993 |
| JP | 2006152385 | A | 6/2006 |
| WO | 98/20182 | A1 | 5/1998 |

OTHER PUBLICATIONS

Examination Search Report dated Nov. 15, 2017 corresponding to European Patent Application No. 15156701.3, 5 pages.

Extended European Search Report dated Oct. 5, 2015 corresponding to European Patent Application No. 15156701.3, 7 pages.

Bangaru et al., "Diffusion coatings of steels: Formation mechanism and microstructure of aluminized heat-resistant stainless steels", J. Vac. Sci. Technol., 1984, pp. 806-815, vol. 2, No. 4.

Matsuoka et al., "Growth Behavior of Coatings Formed by Vapor Phase Aluminizing Using Fe—Al Pellets of Varying Composition," Materials Transactions, 2006, pp. 2341-2347, vol. 47, No. 9.

* cited by examiner

COATING COMPOSITIONS, METHODS AND ARTICLES PRODUCED THEREBY

CROSS-REFERENCE TO PRIOR APPLICATIONS

This application is a divisional of U.S. patent application Ser. No. 14/632,010, filed Feb. 26, 2015, which claims priority under 35 U.S.C. § 119 to U.S. Provisional Application No. 61/944,681, filed Feb. 26, 2014, each hereby expressly incorporated by reference in its entirety and each assigned to the assignee hereof.

FIELD

The present application is directed to compositions useful in the formation of coatings, methods of forming such coatings, and articles produced thereby.

BACKGROUND

In this specification where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

The invention relates, in general, to coatings that protect a substrate against corrosion, oxidation and metal dusting. Such protective coatings are useful, for example, in components used in chemical, petrochemical, power generation industries. Such components may include tubing, gas turbine blades and vanes, nozzles, and many other complex-shaped components, which serve in corrosive environments often at elevated temperatures. There are a variety of specially formulated coatings, such as aluminide-based coatings. These coatings may be obtained through a thermal diffusion method based on the chemical vapor deposition principles, sometimes called "pack cementation." However, such conventional compositions, techniques, and the resulting coatings, possess a number of disadvantages and deficiencies.

In general, aluminide coatings are formed by heating of a powder mixture containing a source of aluminum (Al), an activator and an inert filler. The metallic component is immersed into this powder, and the Al-based species in a gaseous phase deposit onto the metallic substrate surface, diffuse into it and react with iron (Fe) and/or with some other metallic substrate constituents, yielding an aluminide compound, formed as a "coating" onto the substrate. These aluminides have higher corrosion and oxidation resistance, often at elevated temperatures, than the substrate material and therefore protect the components from aggressive environments.

Conventional Al-based compositions mostly contain an Al donor, an activator, and a filler. When a coating process is performed with a composition that lacks an activator, or lacks an activator and a filler, the coating formed thereby is very thin (below 25 μm or even below 15 μm), despite the use of rather high temperatures of 1050° C.-1150° C. and long soak times at such temperatures. These thin coatings are not strong enough to withstand corrosive environments when corrosive media have sufficient flows and concentrations, and the protective coating does not last an adequate amount of time.

Thus, the activator $NH_4CI$ is often used in such conventional compositions, as well as other ammonium halide activators. However, upon their decomposition at elevated temperatures, such activators form gaseous ammonia ($NH_3$), hydrochloric acid (HCl), or other acids. These decomposition products react with aluminum, yielding aluminum chlorides or other aluminum halides, which activate the process. However, these gaseous species are hazardous to health and the environment, and they accelerate the destruction of production equipment utilized in the coating process. Thus, process economy sustainability is diminished.

In addition, such species rapidly volatize and their reaction is difficult to control in large volumes found when treating or coating larger components. Moreover, the aluminized coatings formed using such species may have a rough and uneven surface called "bisque," with elevated contents of Al that associates with higher coating brittleness and chipping. Such coatings exhibit reduced corrosion resistance as well as reduced service life.

The use of some Al-halides as an activator, such as $AlF_3$, $AlCl_3$, or $Na_3AlF_6$ may be preferable to ammonium halide activators in order to avoid the formation of hazardous gases, but the coatings thicknesses (case depth) formed by such activators is often uneven and inadequate.

The parameters of the powders used for the powder mixture containing a source of aluminum (Al), an activator, and an inert filler are not well established. However, not all powders are well-suited for the above-described thermal diffusion coating processing. For instance, particle size can influence the coating process and resulting coating properties. Coarse powders are not very active for the formation of Al-halides, the coating thickness or case depth is small, and the integrity and corrosion resistance of the resulting coating may be not high enough. Fine powders are active, but they tend to form uneven agglomerates and do not have a consistent flow, resulting in rather poor and inconsistent packing with air pockets formed in the powder mixes resulting in coating micro-cracking, uneven thickness or case depth, and elevated "bisque" formation, all of which reduce the coating integrity and corrosion resistance. These effects are especially pronounced for large components to be treated and large volume production.

The Al-based coating process is conducted in high temperature furnaces, often in a protective or inert atmosphere (e.g., in argon or hydrogen) provided within the furnace. The use of furnaces with protective atmospheres is not conducive to the treatment of large products, or the treatment of many components on the same processing run. This is due to the large volume of such protective or inert gases required, making the process uneconomical and inefficient. In addition, the coating thicknesses or case depth are often not large enough. An increase in process temperature and time may increase the case depth, however, this is not desirable because of the steels and alloys of the treated components or substrates can be degraded by elevated temperatures and soak times. For instance, exposure to elevated treatment temperatures can result in elevated migration of chromium or other alloying elements to the surface and around the grains, and possible depletion that makes the metal structure uneven and less ductile.

While certain aspects of conventional technologies have been discussed to facilitate disclosure of the invention, Applicants in no way disclaim these technical aspects, and it is contemplated that the claimed invention may encompass or include one or more of the conventional technical aspects discussed herein.

SUMMARY

It has been discovered that the above-noted deficiencies can be addressed, and certain advantages attained, by the powder composition of the present invention. For example, the present invention provides one or more of the following advantages:

- forms a dense protective coating on at least part of a substrate surface;
- provides a protective coating having an adequate thickness on at least part of a substrate surface;
- avoids the formation of hazardous gases (e.g., ammonia, chlorine-containing or acid-containing) upon heating;
- provides a protective coating having improved homogeneity and relatively lower brittleness; and
- avoids the necessity of providing a protective or inert atmosphere during the treatment or coating process.

Thus, according to one aspect the present invention provides: a powder composition, the composition comprising, as constituents: an aluminum donor powder, an aluminum-containing activator powder comprising at least 50 wt. % $KAlF_4$, and an inert filler powder.

The composition as described above may further include constituents present in the powder in relative amounts, expressed as ratios, of aluminum donor:aluminum containing activator:inert filler, of about 1.5-50:1-20:50-97.5, respectively.

The composition as described above may further include constituents present in the powder in relative amounts, expressed as ratios, of aluminum donor:aluminum containing activator:inert filler, of about 1.75-20:2-10:70-96.25, respectively.

The composition as described above may further include constituents present in the powder in relative amounts, expressed as ratios, of aluminum donor:aluminum containing activator:inert filler, of about 2-10:2.5-7.5:85-95.5, respectively.

The composition may be defined as set forth above, wherein the aluminum donor comprises at least about 50 wt. % Al.

The composition may be defined as set forth above, wherein the aluminum donor comprises elemental Al, an Al alloy, or a combination thereof.

The composition may be defined as set forth above, wherein the Al alloy comprises one or more of: FeAl, CrAl, TiAl, or NiAl.

The composition may be defined as set forth above, wherein the aluminum donor further comprises one or more of: Si, Cr, Ti, or Co.

The composition may be defined as set forth above, wherein the composition comprises about 2.0-6.0 wt. %, or 2.5-3.0 wt. %, aluminum donor.

The composition may be defined as set forth above, wherein the activator comprises at least one other Al-containing halide.

The composition may be defined as set forth above, wherein the at least one other Al-containing halide comprises one or more of: $AlF_3$, $AlCl_3$, or $Na_3AlF_6$.

The composition may be defined as set forth above, wherein the activator is either: (i) free of ammonium halides, or (ii) further comprises an ammonium halide.

The composition may be defined as set forth above, wherein, when present, the ammonium halide comprises at least one of: $NH_4Cl$ or $NH_4F$.

The composition may be defined as set forth above, wherein, when an ammonium halide is present, the activator comprises at least about 80 wt. % $KAlF_4$.

The composition may be defined as set forth above, wherein the composition comprises about 2.5-5.5 wt. %, or 3.0 wt. %, activator.

The composition may be defined as set forth above, wherein the inert filler comprises: $Al_2O_3$, $ZrO_2$, $TiO_2$, $Cr_2O_3$, or combinations thereof.

The composition may be defined as set forth above, wherein the composition comprises about 88.0-94.5 wt. %, or 94.0-94.5 wt. %, inert filler.

The composition may be defined as set forth above, wherein the aluminum donor powder has an average particle size of about 10-75 μm.

The composition may be defined as set forth above, wherein the aluminum donor powder has an average particle size of about 20-50 μm.

The composition may be defined as set forth above, wherein the activator powder has an average particle size of about 10-75 μm.

The composition may be defined as set forth above, wherein the activator powder has an average particle size of about 20-50 μm.

According to a further aspect, the present invention provides a powder composition, the composition comprising, as constituents: an aluminum donor powder, an aluminum-containing activator powder comprising at least 50 wt. % $KAlF_4$, and an inert filler powder, and powder in the form of powder reclaimed after subjecting the powder composition as defined as set forth above to a heat treatment cycle sufficient to form an aluminide-based coating on a substrate.

The composition may be defined as set forth above, wherein the composition comprises about 84.5-88.5 wt. %, or 88.3-88.7 wt. %, reclaimed powder.

The composition may be defined as set forth above, wherein the composition comprises about 5.5-7.5 wt. %, or 6.2 wt. %, inert filler powder.

The composition may be defined as set forth above, wherein the inert filler powder comprises $Al_2O_3$.

The composition may be defined as set forth above, wherein the composition comprises about 2.0-5.5 wt. %, or 2.44-2.83 wt. %, aluminum donor powder.

The composition may be defined as set forth above, wherein the aluminum donor powder comprises elemental Al.

The composition may be defined as set forth above, wherein the composition comprises about 2.25-5.0 wt. %, or 2.65 wt. %, activator powder.

The composition may be defined as set forth above, wherein the activator powder comprises $KAlF_4$.

According to an additional aspect, the present invention provides a method of forming a coating on a substrate, the method comprising: providing a powder having a composition according to any of the preceding claims; placing a surface of the substrate into contact with the powder; and heating both the powder and the substrate at a predetermined temperature and for a predetermined period of time, wherein the temperature and time are sufficient to produce an Al-rich vapor that diffuses into the surface of the substrate and form aluminides thereon.

The method may be defined as set forth above, wherein the powder and the substrate are heated to a temperature of about 750-1150° C.

The method may be defined as set forth above, wherein the powder and the substrate are heated in an ambient atmosphere.

The method may be defined as set forth above, wherein the powder and the substrate are heated in an atmosphere containing an inert or reducing gas.

The method may be defined as set forth above, wherein the method does not produce $NH_3$-containing species.

The method may be defined as set forth above, wherein the method does not produce Cl-containing species.

The method may be defined as set forth above, wherein the substrate contains at least one of: Fe, Cr, Ni, Co, Ti, or V.

The method may be defined as set forth above, wherein the method further comprises placing both the substrate and the powder into a retort, and heating the retort, powder and substrate at a temperature for a predetermined period of time.

According to yet another aspect, the present invention provides a coating architecture produced by the method as defined above, wherein the coating architecture comprises the substrate, a transition layer, a protective layer, wherein the protective layer has a thickness greater than about 25 μm.

The coating may be defined as set forth above, wherein the protective layer has a hardness of about 600-850 HK0.1.

The coating may be defined as set forth above, wherein the transition layer has a hardness of about 300-675 HK0.1.

The coating may be defined as set forth above, wherein the transition layer comprises about 3.5-10 wt. % Al.

The coating may be defined as set forth above, wherein the protective layer comprises a first zone proximate to the transition layer, and a second zone proximate to the first zone.

The coating may be defined as set forth above, wherein the second zone has a thickness less than 25 μm.

The coating may be defined as set forth above, wherein the first zone comprises 25-35 wt. % Al, and the second zone comprises 40-55 wt. % Al.

The coating may be defined as set forth above, wherein the protective layer comprises a single zone disposed proximate to the transition layer.

The coating may be defined as set forth above, wherein the single zone comprises 25-35 wt. % Al.

According to an additional aspect, the present invention provides a coating architecture, the coating architecture comprises a substrate, a transition layer, and a protective layer, wherein the protective layers has a hardness of about 600-850 HK0.1, and a thickness greater than about 25 μm, and wherein the transition layer has a hardness of about 300-675 HK0.1.

The coating may be defined as set forth above, wherein the transition layer comprises about 3.5-10 wt. % Al.

The coating may be defined as set forth above, wherein the protective layer comprises a first zone proximate to the transition layer, and a second zone proximate to the first protective layer.

The coating may be defined as set forth above, wherein the second zone has a thickness less than 25 μm.

The coating may be defined as set forth above, wherein the first zone comprises 25-35 wt. % Al, and the second zone comprises 40-55 wt. % Al.

The coating may be defined as set forth above, wherein the protective layer comprises a single zone disposed proximate to the transition layer.

The coating may be defined as set forth above, wherein the single zone comprises 25-35 wt. % Al.

DETAILED DESCRIPTION

Figure 1:
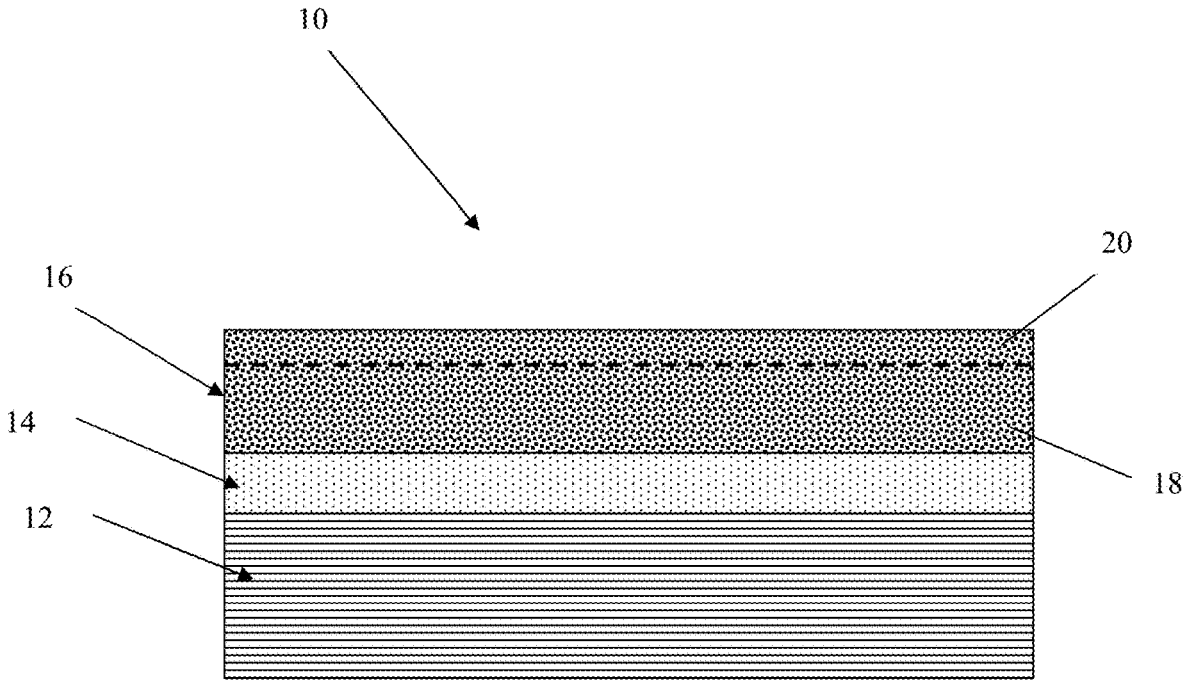
FIG. 1 is a schematic illustration of a coating formed onto a substrate, according to certain illustrative aspects of the present invention.

As used herein, the singular forms "a", "an" and "the" are intended to include the plural forms as well, unless the context clearly indicates otherwise. Additionally, the use of "or" is intended to include "and/or", unless the context clearly indicates otherwise.

As used herein, "about" is a term of approximation and is intended to include minor variations in the literally stated amounts, as would be understood by those skilled in the art. Such variations include, for example, standard deviations associated with techniques commonly used to measure the amounts of the constituent elements or components of an alloy or composite material, or other properties and characteristics.

All of the values characterized by the above-described modifier "about," are also intended to include the exact numerical values disclosed herein. Moreover, all ranges include the upper and lower limits.

All percentages disclosed herein refer to percent by weight, relative to the overall weight of the composition, unless otherwise described herein. The weight percentages of the powder compositions disclosed herein were measured by relative direct weight measurements of the various ingredients and constituents making up the powder. The weight percentages of the elements contained in the coating layer(s) were determined by spectral analysis, termed Energy Dipersive Spectrum (EDS) analysis, in combination with scanning electron microscopy (SEM). More specifically, using the normal electron beam of a SEM as an excitation source, x-rays are emitted from the target area of the coating. Due to the quantization of electron energy levels, the emitted characteristic x-ray energies for elements will generally be different from element to element. The emitted x-rays are detected and used to identify the elements present, and to quantify their amounts. Such techniques are known to those skilled in the art.

The "HK0.1" hardness number values described herein refer to the hardness value measured according to the Knoop hardness test, performed at a load of 0.1 kg force (kgf) according to ASTM Standard E384-$10^{\varepsilon 2}$ (April 2010).

The compositions described herein are intended to encompass compositions which consist of, consist essentially of, as well as comprise, the various constituents identified herein, unless explicitly indicated to the contrary.

According to its broader aspects, the present invention relates to a composition, which may be in the form of a powder, a process of using this composition to form a protective layer or coating on a surface of a substrate, as well as the properties and characteristics of the coating thus formed. The composition and processing conditions have been developed according to the present invention in order to attain a coating that possesses an architecture, properties and characteristics that represent an improvement over the prior art.

According to certain aspects, a composition is provided. Optionally, the composition is in the form of a powder containing aluminum. A substrate, such as a metallic component is placed into this composition, then the metallic substrate and composition is heated up to a certain temperature for a certain period of time. The temperature and time applied are chosen so as to form Al-containing gases in the composition. The metallic component may be with different shapes and sizes, including with complex shapes, e.g., shapes with many holes, cavities and steps, large dimensions, including long (several meters in length) tubes. If all surfaces of the metallic component are to be coated, the composition and the component are placed into container, sometimes called a vessel or retort. If only outer surface of the component is to be coated, the inner surface is closed or masked. Alternatively, an inert powder is placed in contact with the inner surface. Conversely, if only inner surface needs to be coated, the composition is placed inside the component, and the component itself can act as a retort.

According to certain aspects, the composition includes an Al-based powder that serves as an Al donor, an activator, and an inert filler.

Any suitable Al-containing donor substance can be chosen. An Al donor may be in the form of a powder. The Al donor powder may be either an elemental Al powder, an aluminum-containing alloy powder, or a combination thereof. By way of non-limiting example, suitable Al-containing alloys include FeAl, CrAl, TiAl, or NiAl, or combinations thereof. The Al donor powder may also optionally contain additional elements, such as Si, Cr, Ti, Co, Ni, V. According to certain formulations, the content of Al in the Al donor constituent is 50 wt. % or more, relative to the total weight of the Al donor constituent. When the Al donor contains additional elements more complex intermetallide formation may occur due to co-deposition and co-diffusion in the presence of the additional elements.

According to some embodiments, the activator powder includes an aluminum halide salt. According to one aspect, the aluminum halide salt comprises $KAlF_4$. The activator may be composed entirely of $KAlF_4$ (100 wt. %), or may be composed of a combination of $KAlF_4$ with one or more Al-halide salt, and optionally with other substances. The salt $KAlF_4$ decomposes to $AlF_3$ and KF salts at elevated temperatures. $AlF_3$, being a volatile product, deposits onto the substrate reacting with the elements of the substrate (e.g., with Fe, Cr, etc.). $AlF_3$ also reacts with Al from the composition yielding other forms of Al—F gaseous species, such as $AlF_2$, which also deposits onto the substrate reacting with the elements contained in the substrate. The other optional Al-halide salts may include, for example, $AlF_3$, $AlCl_3$, $Na_3AlF_6$, or AlBr. Although not necessarily preferred, the activator may additionally contain an ammonium halide, such as $NH_4Cl$ or $NH_4F$. When the activator is composed of a mixture of $KAlF_4$ with other Al-halides, the content of $KAlF_4$ is at least 50 wt. %, preferably, greater than 75 wt. %, with respect to the total weight of the activator. When the activator is composed of a mixture that includes $KAlF_4$ and an ammonium halide, the content of $KAlF_4$ is at least 80 wt. % of the total weigh of the activator. Of course, the activator may be entirely free of ammonium halides. According to the principles of the present invention, it has been found that coating powder compositions having at least the amounts of $KAlF_4$ activator indicated above provides favorable results. If the content of $KAlF_4$ in the above mentioned activator compositions is less than the amounts indicated above, the quality of the coating is adversely impacted (e.g., a less even and rougher surface results). Also, if the content of ammonium halide is greater than 20%, excessive amounts of HCl or HF, and $NH_3$, occur at elevated temperatures, which negatively affect the environment and result in corrosion of the working equipment.

According to further embodiments, the inert filler can be in the form of any suitable substance that does not adversely impact the formation of the desired coating composition and/or structure. By way of example, the inert filler can contain one or more oxide powder(s), such as $Al_2O_3$, $ZrO_2$, $Cr_2O_3$, $TiO_2$, or combinations thereof. According to one optional embodiment, the inert filler contains $Al_2O_3$ powder. $Al_2O_3$ powder has been found to perform effectively, and is a relatively low-cost substance. The inert filler can be formed exclusively of $Al_2O_3$ powder, or it can be formed as a combination of $Al_2O_3$ powder and another substance, such as one of the abovementioned oxides. According to certain alternative embodiments, when the inert filler is in the form of a combination of $Al_2O_3$ powder and another substance, the inert filler comprises at least 50 wt. % $Al_2O_3$ relative to the entire weight of the inert filler constituent. The inert filler may either be in the form of a "fresh" powder, or it may be the powder reclaimed from a previous thermal diffusion coating cycle or treatment process ("used" powder), or a combination of "fresh" and "used" powders.

All three abovementioned constituents, the Al donor, the activator and the inert filler, are mixed together thoroughly to obtain a homogeneous mixture or composition. Any type of equipment, which allows the formation of a homogeneous mixture, can be used. The homogeneous powder mixture is characterized by a lack of lumps, agglomerates, and good flowability to allow the mixture to fill retort and surround the working component or substrate, that may have small cavities and/or holes therein.

According to certain embodiments, the powder mixture possesses and overall composition such that the ratios of relative weight percentages of the Al donor:activator:inert filler is=(1.5-50):(1-20):(50-97.5). According to further embodiments, these ratios are (1.75-20):(2-10):(70-96.25), or (2-10):(2.5-7.5):(85-95.5).

According to additional embodiments, the powder mixture may have a composition characterized by one or more of the following amounts. The powder mixture can include about 2.0-6.0 wt. %, or 2.5-3.0 wt. %, Al donor. The powder mixture may have about 2.5-5.5 wt. %, or 3.0 wt. %, activator. The powder mixture can have about 88.0-94.5 wt. %, or 94.0-94.5 wt. %, inert filler.

When the powder mixture includes "used" powder, the mixture may have a composition characterized by one or more of the following amounts. The powder mixture may include about 2.0-5.5 wt. %, or 2.44-2.83 wt. %, aluminum donor powder. The powder mixture may have about 2.25-5.0 wt. %, or 2.65 wt. %, activator powder. The powder mixture may have about 5.5-7.5 wt. %, or 6.2 wt. %, inert filler powder ("new"). The powder mixture may have about 84.5-88.5 wt. %, or 88.3-88.7 wt. %, reclaimed ("used") powder. The constituent Al donor, activator and inert filler can have any of the compositions, features or characteristics described above.

The compositions detailed above provide advantages such as, inhibiting forming gases, better controlled high-temperature reactions, better control of the coating thickness (case depth), formation of smoother coatings with less roughness. Mixtures falling outside these preferred compositions are prone to elevated roughness, as well as higher Al contents in the coating, and the consequential formation of micro-cracks occur. Also, the abovementioned compositions provide lower cost. Compositions having Al donor and/or activator content lower than the amounts stated herein lack adequate gaseous phase formation, and the interaction between Al particles and Al-based gaseous species is also insufficient, resulting in uneven and very thin case depth that would not be effective for adequate corrosion protection of the substrate.

According to some alternative embodiments, the Al donor powder comprises particles with an average particle size of 10-75 μm, or 20-50 μm. If the particle size of the Al donor powder is larger than the range specified above, it can become less reactive than is desirable, and the interaction between Al and Al-based gaseous species is not very active resulting in a reduction in both the uniformity of the coating and case depth. Also, the coating is formed less efficiently that is desired. If the Al donor powder has a particle size smaller than specified above (e.g., below 10 μm), the interaction between Al and Al-based gaseous species is rather fast, the diffusion of Al and interaction with Fe, Cr, Ni and other elements from the substrate are rather intensive resulting in an elevated content of Al in the case depth, particularly in the top layer. Also, the case depth becomes more uneven and brittle with elevated amounts of the micro-cracks, thus resulting in a coating that has in adequate or undesirable corrosion resistance. Moreover, when the size of the Al donor particles are smaller than specified above, some agglomeration and caking of the powder may occur, thus adversely impacting the handling and flowability of the powder.

According to further alternative embodiments, the activator powder comprises particles with average particle size of 10-75 μm, or 20-50 μm. If this powder has a particle size greater than specified above, decomposition and Al-halide ($AlF_3$ and other) formation is delayed, which in turn hinders Al diffusion, adversely impacting coating uniformity and case depth. If the activator powder has a particle size smaller than specified above, the gaseous phase formation occurs rather quickly, making the interaction of Al and Al-based gaseous species difficult to control, thus the diffusion of Al and interaction with Fe, Cr, Ni and other elements from the substrate are rather intensive resulting in an elevated content of Al in the case depth, particularly in the top layer. Thus, the case depth becomes more uneven and brittle with elevated amounts of the micro-cracks. Such coating properties make it ineffective for preventing corrosion.

The inert filler powder may have a rather wide range of particle sizes. For instance, the inert filler may comprise particles having an average size of a few microns to several tens of microns. The main requirements of the filler is to be inert, in other words, to avoid interaction with the Al donor and the products of the decomposition of the activator. The inert filler should also have no agglomerates and have good flowability. Inert filler with particles of sub-micron size may interact with Al-species at high temperatures, and make recovery of the powder for reuse after completion of a thermal diffusion coating cycle difficult. Very coarse powders (e.g., larger than approximately 50 μm) cannot be blended very uniformly with the Al donor and activator powders, and thus are not desirable.

Certain aspects of the present invention are directed to a process for treating a substrate, or forming a protective coating on at least a portion of a surface thereof, which involves utilization of any of the above-described powder compositions. Although it is envisioned that the above-described powder compositions could be utilized in a number of different ways, according to certain embodiments, the powder is used to treat at least a portion of the surface of a substrate utilizing a thermal decomposition and diffusion type process. Other than using a powder composition as described above, the parameters of such process can vary and are comprehended by the principles of the present invention. Generally speaking, according to one embodiment, a method of forming a coating, or treating a surface, on at least a portion of a substrate can optionally include (which may or may not be performed in the precise order presented as follows): providing a powder having a composition as described above, placing a surface, or at least a portion of a surface, of a substrate into contact with the powder composition; and heating both the powder in the substrate to a predetermined temperature, for a predetermined period of time, wherein the temperature and time are sufficient to produce an aluminum-rich vapor that diffuses into the surface of the substrate and forms aluminides thereon and/or therein.

By way of illustration, a suitable thermal decomposition/diffusion treatment process can also include one or more of the following steps or parameters (which may or may not be performed in the order presented below):

- Surface preparation of the substrate. At least a portion of a surface of a component to be treated or coated for protection are cleaned from dust, grease and other impurities by brushing and treatment with solvents. Also the surface can be treated using the blasting with coarse alumina powder that provides additional cleaning and removal of the surface abnormalities creating a smoother surface.
- Preparation of the powder mixture. A powder mixture having any of the compositions, features and/or characteristics described above is prepared.
- Placement of the component that needs to be coated into the powder mixture. If only an inner surface (e.g., tubular component) is to be coated, the powder is placed into the interior of the component. If all surfaces (both inner and outer) are to be coated, the powder is placed into the interior of the component, and the component is placed into special container (retort), and the powder mixture is filled between the retort and the outside of the component, so the whole body of the component is immersed in the powder. If some particular surfaces of the component should not be coated (e.g., for the welding purpose or the component threads), these surfaces are "masked." The retort is sealed. One or several components to be treated can be placed into the retort.
- Heating the component and powder mixture. The retort and/or the component are placed into a high-temperature furnace. Several retorts or components may be placed into the furnace. The furnace can be a gas-fired or conventional electric furnace. The heating schedule (time and temperature parameters) define a heating profile (e.g., heating-soak-cooling), and is determined by, for example, the size and shape of the components, composition of the metallic component and by the required coating thickness (case depth).
- Coating formation. During the heat treatment, a vapor phase is formed due to the decomposition of the activator, which reacts with Al resulting in the formation of Al-rich vapor, including Al vapor, then these vapors deposit onto the heated metallic substrate, the deposited Al diffuses into the metallic surface resulting in the formation and subsequent growth of iron aluminides (as well as some other aluminides depending on the composition of the metallic component), which provide the protective coating.

Post treatment. Powder is removed from the surface of the treated component(s) after cooling, the treated component can the be inspected and subjected to subsequent mechanical treatment (if required).

The substrate material can comprise any suitable material. Although the substrate materials may have different compositions, e.g., different alloying metals may be presented in different quantities, they can be processed to form a protective coating or layer using the powder mixture compositions detailed above. Suitable substrates include steel alloys, such as ferrous or non-ferrous alloys. More specifically, suitable examples include carbon steels, low alloy steels, stainless steels (347, 304, 310, 316 and other grades), nickel-based alloys (such Inconel® and other grades), titanium alloys and/or others alloys containing containing Fe, Cr, Ni, Co, Ti, and/or V.

According to some embodiments, the heat treatment is conducted at the final treatment or soak temperature of 750-1150° C. The temperature can be ramped-up quickly because the metallic substrates can resist fast heating without degradation, and the heating rate is mostly defined by the capability of heating equipment. The soak time at the final temperature may be from a few hours to more than 10 hours, and is selected based on the size and shape of the components to be treated, heating equipment capability, required case depth, as well type of substrate material. If the final temperature is lower than 750° C., the diffusion rate is very low, and the case depth is too small and not very consistent, even with a long soak time. If the final temperature is greater than 1150° C., metallic substrate degradation may occur. For example, substrates that include Cr may exhibits a Cr depletion problem that reduces the ductility and the tensile properties of the metal. At the same time, because the process is diffusion-based, the temperature increase cannot provide a sufficient case depth growth. The heat treatment can be conducted without special protective conditions, i.e. in air, or, in the case of special requirements for the metallic substrate, in an inert or reducing atmosphere. However, in the cases of no special demands, the process is conducted in air as a less expensive option and which does not require expensive heat treatment equipment and treatment gasses.

Because of the composition of the working powder mixture and heat treatment conditions of the present invention, hazardous gases, e.g., Cl-based, $NH_3$-based and others, are not formed during the treatment process. Thus, the treatment process is environmentally safer, and less destructive to the processing equipment (e.g., exhaust fans, pipes and lining).

When the aluminizing process is completed, the workpieces are removed from the mix, cleaned up (by brushing, air blowing, etc.) and inspected. The remaining powder can be reused as at least a portion of the inert filler for the next powder mixture preparation.

The coating or protective layer formed on the substrate can also have preferred architectures. FIG. 1 is a schematic illustration of preferred coating or layer architectures formed according to certain aspects of the present invention. As illustrated therein, the coating architecture 10 may comprise a substrate 12 with a protective coating or layer formed thereon comprising a transition zone 14 and an Al-rich protective layer 16. The Al-rich protective layer 16 can optionally be in the form of two zones; namely, a first zone 18 and a second zone 20. The Al-rich protective layer 16 can have any suitable thickness. According to one example, the Al-rich top zone 20 has a thickness of about 25 μm or less. The transition zone 14 is provided between the substrate 12 and the Al-rich layer 16. Without wishing to be bound by any particular theory, it is believed that the formation of the layers includes the deposition of volatile Al species onto the substrate, diffusion of Al inside the substrate, formation of intermetallides, such as iron aluminide, chrome aluminide, and the like. These aluminides diffuse into the substrate. At the same time, the some elements from the substrate (e.g., Ni, Cr, Fe, etc.) diffuse outward in the opposite direction, and the formation of aluminides with higher contents of Al occurs. The transition zone may have different thickness that is defined by the composition of the base steel or alloy. For example, the transition zone 14 can have a thickness of about 60-80 μm, or up to 100 μm, in the case of stainless steel 347SS. When the substrate is an 800H alloy, a suitable transition zone 14 thickness can be about 20-40 μm. The content of Al in this transition zone 14 can be rather small, and can be about 3.5-10 wt. %. The major phase present in the transition zone 14 consists of can be $Fe_3Al$, and similar intermetallides, which are rich in the elements from the substrate material. Due to the inward diffusion of Al and outward diffusion of metals and metal-rich aluminides, the Al-rick layer 16 or can have an Al content of about 25-35 wt. %, and this layer can also have a thickness that is larger than the thickness of the transition zone 14. The thickness of the Al-rich layer 16 depends on the base (substrate) material composition and structure, as well as the process temperature and time. In some cases, the Al-rich layer has a top zone 20, as mentioned above, with a thickness of about 25 μm or less, such as 10-15 μm. The Al content in this top zone 20 can be about 40-55 wt. %, such as 42-50 wt. %. When two zones are provided, the Al content of the first zone can be about 25-35 wt. %. Although the coating thickness (case depth) and thicknesses of each layer cannot be standardized, their thicknesses and the structure of the coating can be managed using the approach described above. The case depth (coating thickness, including thickness of different zones) was determined for the cross-sections of the cut tubular components or flat bars coated under an optical microscope or Scanning Electron Microscope. The elemental analysis, in particular, the determination of Al contents in different areas (layers) of the coatings, was conducted using the X-ray Energy Dispersive Spectrum (EDS) analysis.

According to some embodiments, the increase in coating hardness from the substrate 12 to the transition zone 14 and then to the main Al-rich layer 16 for the proposed technical solution is more gradual in comparison with known solutions. Hardness of the coatings and individual layers was determined in accordance with ASTM E384-10 using the rhombohedral pyramid diamond indenter (Knoop hardness) with a 100-g load (i.e. HK0.1) when the diamond indenter was applied exact to the tested area of the cross-section of the cut coated component. For example, in the case of aluminizing coatings on stainless steels, the hardness of the substrate (steel) is about 180-200 HK0.1, while the hardness of the transition zone 14 is about 300-675 HK0.1, or 340-400 HK0.1. The hardness of the main Al-rich zone 16 is in the range of 600-850 HK0.1, or 600-700 HK0.1. These coatings are not brittle despite the rather high hardness of the main layer. Even a presence of thin, (below 25 μm) top zone 20 with an Al content of 40-50 wt. % and a hardness of 700-720 HK0.1 does not deteriorate the coating integrity and no cracks are observed. In comparison, when a known powder mix composition (e.g., based on a mix of the powders Al, $NH_4Cl$ and $Al_2O_3$) is used, hardness of the transition zone is in the range of 240-280 HK0.1 and hardness of the main Al-rich zone is greater than 700 HK0.1 (700-760), with the wide variations in hardness apparently due to elevated contents of Al. In this conventional coating, the increase in hardness from the substrate to the main zone is not gradual, and these coatings demonstrate a brittle behavior. When metallic substrates with a high-content of alloying elements are used as the base or substrate material (e.g., 800H alloy and other Inconel® grades), the hardness of the transition zone is higher and the transition zone is thinner due to the outward diffusion of the alloying elements. But again, in the case of applying the proposed technical solution to the coating of these metallic components, the change in hardness values for different zones is less drastic compared with coatings obtained using known aluminizing powder mixture compositions.

The aluminide coatings on steels and alloys with the proposed architecture and composition obtained through the proposed powder mixture compositions and properties are well-suited for the service in corrosive and oxidation environments at elevated temperatures and against metal dusting in chemical, petrochemical, power generation industries, due to their high integrity.

Different embodiments of the invention are describes by the following examples. These examples are presented for purposes of illustration only, and should not be construed as limiting the scope of the claimed invention.

EXAMPLE 1

A tubular section of stainless steel grade 347 (Cr+Ni content of approximately 26-27%) with dimensions of approximately 62 mm (2.44") inside diameter, approximately 5 mm (0.2") wall thickness and approximately 610 mm (2 ft.) length was blasted with alumina sand and then washed with acetone and air dried. This tube section was placed into a steel retort of larger diameter with a powder mixture. The powder mix was placed inside the tube and surrounded the outside of the tube as well. This mixture contained the following ingredients: aluminum (Al) powder 3 wt. %, potassium aluminum fluoride ($KAlF_4$) powder 3 wt. % and aluminum oxide ($Al_2O_3$) powder 94 wt. %. The Al and $KAlF_4$ powders, which were used as a donor and as an activator, respectively, had average particle size of about 25-30 μm, while the $Al_2O_3$ powder used as an inert filler had average particle size of about 2.5-3.5 μm. The retort with the powder mix and the tube was placed into a furnace, heated to 900° C., held at this temperature for 5 hrs., and then cooled. The tubular section was taken from the cold retort, cleaned of the powder, and inspected. The tube was sectioned creating smaller samples for evaluation of case depth (coating thickness and structure) and Knoop hardness.

Figure 2:
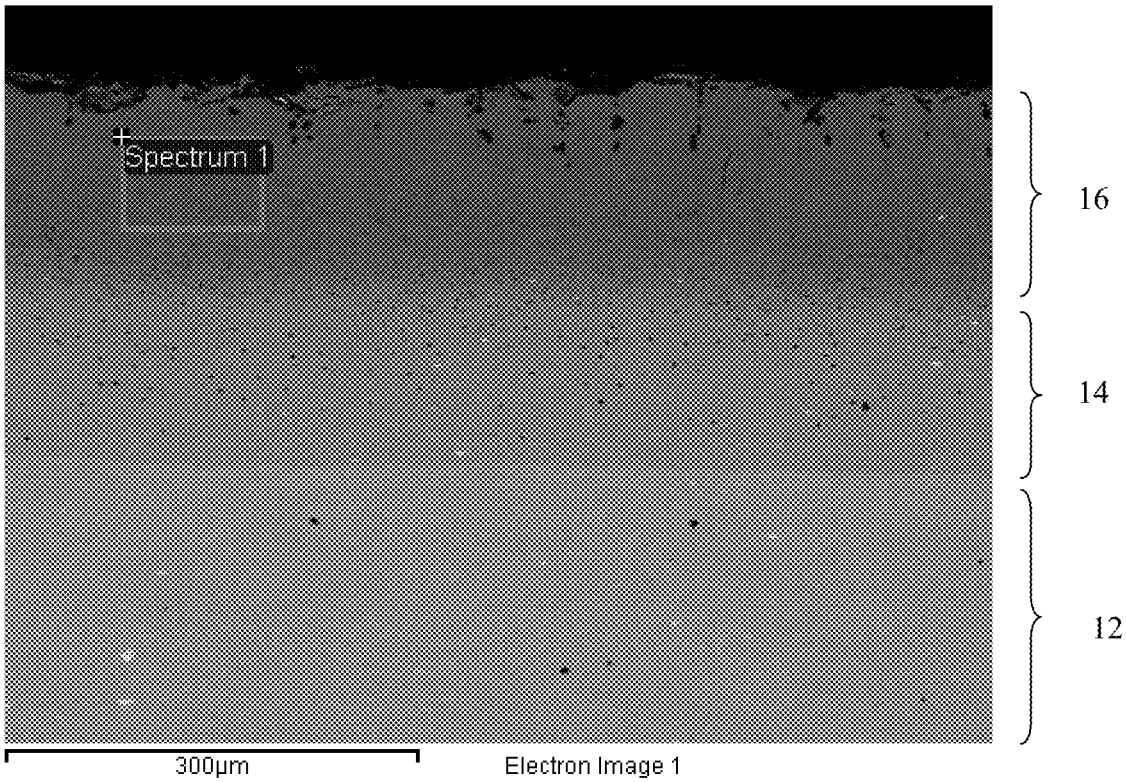
FIG. 2 is a photomicrograph of a coating according to additional aspects of the present invention.

The obtained coating was studied under the microscope and a uniform structure on both inner and outer surfaces without loosely compacted and rough top layers and with no micro-cracks was observed. See FIG. 2. The substrate 12, transition zone 14 and protective layer 16 are identified therein. The entire protective coating (zone 16) was approximately 120-130 μm thick (case depth), with the transition zone 14 being approximately 65-75 μm thick. No porosity between the layers or zones was observed. Using the X-ray Energy Dispersive Spectrum (EDS) analysis, the Al contents in these layers or zones was determined. The protective coating layer 16 had an Al content of approximately 34 wt. %, while the transition zone 14 had an Al content of approximately 7 wt. %. Knoop hardness determined for each layer or zone in accordance to ASTM E384-10 at a 100-g load (HK0.1) was 625-675 for the outer protective coating layer 16 and 350-380 for the transition zone 14. Taking into account that substrate steel 12 had hardness 180-185 HK0.1, it may be concluded that a gradual hardness increase from the steel through the coating was attained. The absence of the cracks between the zones or layers and at the surface confirmed this point. The obtained coating structure contained iron aluminides, as well as iron-chromium- and iron-nickel aluminides, formed due to the interaction of Al with Fe and with other major elements from stainless steel. The obtained coating provides high integrity service, particularly for corrosion protection applications. Due to the selected composition of the mixture, hazardous fumes, such as HCl, were not formed during the coating process.

EXAMPLE 2

A tubular section of Ni—Cr ferrous alloy grade 800H (Cr+Ni content of approximately 50-51 wt. %) with dimensions as in Example 1 was prepared using the same procedure as described in Example 1. The general procedure of the coating formation was the same as described in Example 1, but the mix had the following composition: aluminum (Al) powder 2.75 wt. %, potassium aluminum fluoride ($KAlF_4$) powder 3.0 wt. % and aluminum oxide ($Al_2O_3$) powder 94.25 wt. %. The heat treatment was conducted at temperature 930° C. using a 7 hr. soak.

Figure 3:
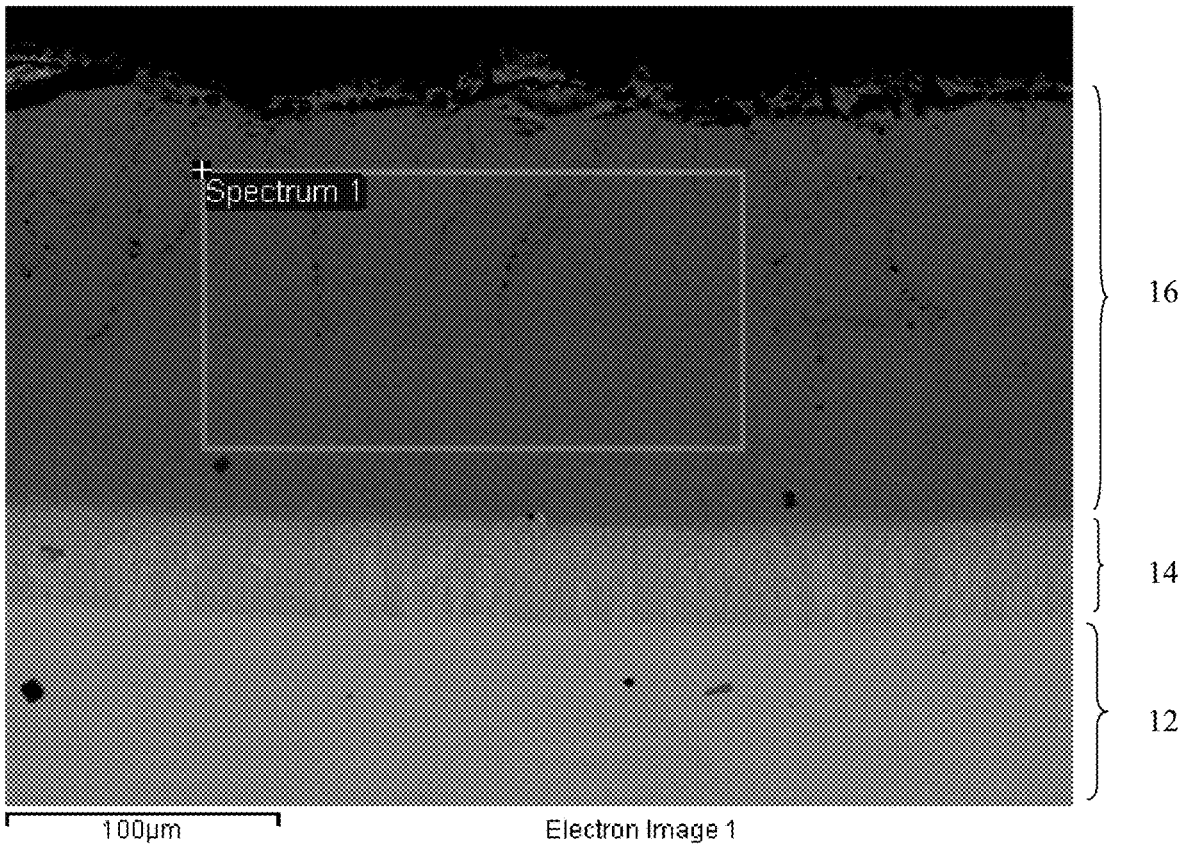
FIG. 3 is a photomicrograph of a coating according to still further aspects of the present invention.

The obtained coating was examined under a microscope. See FIG. 3. The substrate 12, transition zone 14 and protective layer or coating 16 are identified therein. The coating had a uniform structure on both inner and outer surfaces without loosely compacted and rough top zones or layers and with no micro-cracks. The entire protective coating zone (zone 16) was approximately 125-140 μm thick (case depth), with a transition zone 14 of approximately 30-40 μm thick. No porosity between the zones or layers was observed. Based on the EDS analysis, the Al content in the protective coating layer 16 was approximately 35 wt. %, while the transition zone 14 had an Al content of approximately 5.5 wt. %. Knoop hardness was determined for the zones or layers in accordance to ASTM E384-10 at a 100-g load (HK0.1) and was 770-815 for the outer protective coating layer 16, and 620-640 for the transition zone 14. Taking into account that the substrate alloy had hardness 185-200 HK0.1, it may be concluded that gradual increase in hardness values from the steel substrate through the coating was attained, and the absence of the cracks between the zones and at the surface confirmed this point. The obtained coating structure contained iron aluminides, as well as iron-chromium and iron-nickel aluminides, formed due to the interaction of Al with Fe and with other major elements from the alloy. The obtained coating provides high integrity service, particularly for corrosion protection applications. Higher hardness of the transition zone 14 in this example is explained by the outward diffusion of Ni and Cr into the coating structure; the content of Ni+Cr for 800H steel is significantly higher compared with 347 stainless steel used in the first Example. Due to the selected composition of the mixture, hazardous fumes such as HCl were not formed during the coating process.

EXAMPLE 3

A tubular section of stainless steel grade 347 with the same dimensions as described in Example 1 was prepared and processed as described in Example 1. The powder mixture was formulated with the following composition: aluminum (Al) powder 2.6 wt. %, potassium aluminum fluoride ($KAlF_4$) powder 2.75 wt. %, aluminum oxide ($Al_2O_3$) powder 6.2 wt. %, and the remainder (88.45 wt. %)

powder recovered from processing run (subsequent to the completion of the coating process) described in Example 1. The recovered powder was composed mostly $Al_2O_3$. The heat treatment was conducted at 950° C. for 5 hrs.

The obtained coating had a uniform structure on both inner and outer surfaces without loosely compacted and rough top zones and with no micro-cracks. The entire coating zone was approximately 150-175 μm thick (case depth) with a thin top protective layer of approximately 10-15 μm and a transition zone of approximately 80-100 μm thick. No porosity between the zones was observed. Based on the EDS analysis, the Al content in the entire protective coating layer was approximately 33 wt. %, and was approximately 42 wt. % in the top thin protective zone. The transition zone had an Al content of approximately 6.5 wt. %. Knoop hardness determined in accordance to ASTM E384-10 at a 100-g load (HK0.1) was 650-680 for the protective coating layer and 350-380 for the transition zone. It may be concluded that a gradual increase in hardness from the steel substrate to the coating was attained, and the absence of the cracks between the zones or layers and at the surface confirmed this point. The obtained coating structure contained of iron aluminides, as well as iron-chromium- and iron-nickel aluminides formed due to the interaction of Al with Fe and other major elements from stainless steel. The obtained provides high integrity service, in particular, for corrosion protection. Due to the selected composition of the powder mixture, hazardous fumes, such as HCl, were not formed during the coating process.

EXAMPLE 4

A tubular section of stainless steel grade 347 with the same dimensions as described in Example 1 was prepared and basically processed as described in Example 3. The powder mixture was formulated to have the following composition: aluminum (Al) powder 2.6 wt. %, potassium aluminum fluoride ($KAlF_4$) powder 2.0 wt. %, aluminum fluoride (AlF) powder 0.75 wt. %, aluminum oxide ($Al_2O_3$) powder 6.2 wt. %, and the remainder (88.45 wt. %) powder recovered from the processing run (subsequent to the completion of the coating process) described in Example 1. The recovered powder was composed mostly of $Al_2O_3$.

The obtained coating had a uniform structure on both inner and outer surfaces without loosely compacted and rough top zones and with no micro-cracks. The entire coating was approximately 140-160 μm thick (case depth), with a thin top zone of approximately 15-25 μm, and a transition zone approximately 80-100 μm thick. No porosity between the zones or layers was observed. Based on the EDS analysis, the Al content in the protective coating layer was approximately 32 wt. %, and approximately 43 wt. % in the top thin zone. The transition zone had an Al content of approximately 7 wt. %. Knoop hardness was determined for the coating in accordance to ASTM E384-10 at a 100-g load (HK0.1) and was 655-685 for the protective coating layer, and 340-370 for the transition zone. It may be concluded that a gradual increase in hardness from the steel substrate through the coating was attained. The absence of the cracks between the zones or layers and at the surface confirmed this point. The obtained coating structure contained of iron aluminides, as well as iron-chromium- and iron-nickel aluminides, formed due to the interaction of Al with Fe and with other major elements from stainless steel. The obtained coating provides high integrity service, in particular, for corrosion protection applications. Due to the selected composition of the powder mixture, hazardous fumes, such as HCl did not occur during the coating process.

Similar results were obtained with formation of aluminide coatings on carbon steels, other stainless steels (e.g., grades 304, 316, 310), nickel-based alloys (e.g., Inconel® 718) and titanium alloys.

COMPARATIVE EXAMPLE

A tubular section of stainless steel grade 347 with the same dimensions as described in Example 1 was prepared. The mix for processing contained the following ingredients: aluminum (Al) powder 3 wt. %, ammonium chloride ($NH_4Cl$) 0.5 wt. %, and aluminum oxide ($Al_2O_3$) powder 96.5 wt. % (as a blend of fresh powder and used powder recovered from prior run of the same process). The heat treatment was conducted at 950° C. for 5 hrs.

The obtained coating had some areas of a loosely compacted porous structure with rough areas on both inner and outer surfaces and with occasional micro-cracks. The coating zone contained a rough area with uneven thickness of 15-35 μm on the top, the entire coating zone of approximately 125-150 μm thick, and a transition zone approximately 50-75 μm thick. In some areas of the surface, micro-cracks initiated from the uneven rough area on the top of the surface propagated through the main coating zone. This may attributed to fast formation of the gaseous phase due to decomposition of $NH_4Cl$ and generation of high gas pressure. Based on the EDS analysis, the Al content in the rough and loosely-compacted top zone (called "bisque") was approximately 55 wt. %, was approximately 37 wt. % in the protective layer, and approximately 4.5 wt. % in the transition zone. Knoop hardness was determined for coating in accordance with ASTM E384-10 at a 100-g load (HK0.1) and was 680-750 for the protective coating layer, and 250-280 for the transition zone. The top zone of the coating (a "bisque" area) was significantly more brittle, and the Knoop hardness could not be determined accurately. It may be concluded that the increase in hardness from the steel substrate to the coating is significantly more abrupt than the composition and process of the invention. The presence of cracks between zones, in particular, between the main zone and the Al-rich top zone, confirmed this point. The obtained coating structure contained iron aluminides, as well as iron-chromium- and iron-nickel aluminides, formed due to the interaction of Al with Fe and with other major elements from stainless steel. The rough surface and micro-cracks on the surface due to elevated brittleness cannot provide high integrity service, in particular for corrosion protection applications. Due to the presence of $NH_4Cl$ in the mix composition, hazardous fumes, such as HCl and ammonia, were formed during the decomposition of this salt, and these fumes corrode the processing equipment.

In view of the above, it will be seen that the several advantages of the invention are achieved and other advantages attained.

As various changes could be made in the above methods and compositions without departing from the scope of the invention, it is intended that all matter contained in the above description shall be interpreted as illustrative and not in a limiting sense.

Any numbers expressing quantities of ingredients, constituents, reaction conditions, and so forth used in the specification are to be interpreted as encompassing the exact numerical values identified herein, as well as being modified in all instances by the term "about." Notwithstanding that the numerical ranges and parameters setting forth, the broad scope of the subject matter presented herein are approximations, the numerical values set forth are indicated as precisely as possible. Any numerical value, however, may inherently contain certain errors or inaccuracies as evident from the standard deviation found in their respective measurement techniques. None of the features recited herein should be interpreted as invoking 35 U.S.C. § 112, paragraph 6, unless the term "means" is explicitly used.

I claim:

1. A powder composition, the composition comprising, as constituents: an aluminum donor powder, an aluminum-containing activator powder comprising at least 50 wt. % $KAlF_4$, and an inert filler powder.

2. The composition of claim 1, wherein the constituents are present in the powder in relative amounts, expressed as ratios, of aluminum donor: aluminum containing activator: inert filler, of about 1.5-50: 1-20:50-97.5, respectively.

3. The composition of claim 1, wherein the aluminum donor comprises at least about 50 wt. % Al.

4. The composition of claim 3, wherein the aluminum donor comprises elemental Al, an Al alloy, or a combination thereof.

5. The composition of claim 4, wherein the Al alloy comprises one or more of: FeAl, CrAl, TiAl, or NiAl.

6. The composition of claim 4, wherein the aluminum donor further comprises one or more of: Si, Cr, Ti, or Co.

7. The composition of claim 1, wherein the composition comprises about 2.0-6.0 wt. % aluminum donor.

8. The composition of claim 1, wherein the activator comprises at least one other Al-containing halide, and wherein the at least one other Al-containing halide comprises one or more of: $AlF_3$, $AlCl_3$, or $Na_3AlF_6$.

9. The composition of claim 1, wherein the activator is either: (i) free of ammonium halides, or (ii) further comprises an ammonium halide.

10. The composition of claim 9, wherein, when present, the ammonium halide comprises at least one of: $NH_4Cl$ or $NH_4F$.

11. The composition of claim 9, wherein, when an ammonium halide is present, the activator comprises at least about 80 wt. % $KAlF_4$.

12. The composition of claim 1, wherein the composition comprises about 2.5-5.5 wt. % activator.

13. The composition of claim 1, wherein the inert filler comprises: $Al_2O_3$, $ZrO_2$, $TiO_2$, $Cr_2O_3$, or combinations thereof.

14. The composition of claim 1, wherein the aluminum donor powder has an average particle size of about 10-75 μm, and the activator powder has an average particle size of about 10-75 μm.

15. The composition of claim 1, further comprising powder reclaimed after subjecting the powder composition to a heat treatment cycle sufficient to form an aluminide-based coating on a substrate.

16. The composition of claim 15, wherein the composition comprises about 84.5-88.5 wt. %, reclaimed powder.

17. The composition of claim 15, wherein the composition comprises about 5.5-7.5 wt. % inert filler powder.

18. The composition of claim 1, wherein the aluminum donor powder has an average particle size of about 20-50 μm, the activator powder has an average particle size of about 20-50 μm, and the inert filler powder has an average particle size of about 50 μm or less.

19. The composition of claim 18, wherein the composition comprises about 2.0-6.0 wt. % Al donor powder, 2.5-5.5 wt. % activator powder, and about 88.0-94.5 wt. % inert filler powder.

20. The composition of claim 19, wherein the composition comprises about 2.5-3.0 wt. % Al donor powder, and 2.75-3.0 wt. % activator powder.

21. A method of forming a coating on a substrate, the method comprising:

providing a powder having a composition according claim 1;

placing a surface of the substrate into contact with the powder; and heating both the powder and the substrate at a predetermined temperature and for a predetermined period of time, wherein the temperature and time are sufficient to produce an Al-rich vapor that diffuses into the surface of the substrate and form alum inides thereon.

22. The method of claim 21, wherein the powder and the substrate are heated to a temperature of about 750-1150° C. in an ambient atmosphere or an atmosphere containing an inert or reducing gas.

23. The method of claim 21, wherein the method further comprises placing both the substrate and the powder into a retort, and heating the retort, powder and substrate at a temperature for a predetermined period of time.

* * * * *